United States Patent [19]

Nada et al.

[11] Patent Number: 4,745,742

[45] Date of Patent: May 24, 1988

[54] DUAL PATH EXHAUST PIPE FOR MOUNTING AN OXYGEN SENSOR

[75] Inventors: Mitsuhiro Nada, Susono; Hiroshi Sawada, Gotenba, both of Japan

[73] Assignee: Toyota Jidosha Kabushiki Kaisha, Aichi, Japan

[21] Appl. No.: 85,965

[22] Filed: Aug. 17, 1987

[30] Foreign Application Priority Data

Aug. 20, 1986 [JP] Japan ..... 61-125788[U]

[51] Int. Cl.[4] ..... F01N 3/10

[52] U.S. Cl. ..... 60/276; 60/323

[58] Field of Search ..... 60/276, 323

[56] References Cited

U.S. PATENT DOCUMENTS 4,484,440 11/1984 Oki ..... 60/276
4,656,830 4/1987 Ohno ..... 60/276

FOREIGN PATENT DOCUMENTS 2725944 12/1978 Fed. Rep. of Germany ..... 60/276
3132686 3/1983 Fed. Rep. of Germany ..... 60/276
60-3225 1/1985 Japan .
61-19754 2/1986 Japan .

*Primary Examiner*—Douglas Hart
*Attorney, Agent, or Firm*—Kenyon & Kenyon

[57] ABSTRACT

A dual exhaust pipe segment for mounting an oxygen sensor is connected to a dual exhaust manifold of an internal combustion engine. The exhaust pipe segment comprises a communicating portion where the two paths communicate with each other. The communicating portion defines an oxygen sensor mounting location. The exhaust pipe further comprises tapered inwardly facing surfaces upstream of the oxygen sensor installing position. Tapers of the tapered inwardly facing surfaces are determined such that extension of the tapered inwardly facing surfaces tangentially contact an outside surface of the oxygen sensor. As a result of this structure, almost all gas flowing from every cylinder of the engine can contact the oxygen sensor, and the temperatures of gas contacting the oxygen sensor are decreased to an appropriate extent relative to a sensor mounting location inside the dual exhaust manifold.

15 Claims, 4 Drawing Sheets

(IN CASE OF α = 30°)

DUAL PATH EXHAUST PIPE FOR MOUNTING AN OXYGEN SENSOR

BACKGROUND OF THE INVENTION

1. Field of the Invention

The present invention relates to an exhaust pipe for mounting an oxygen sensor and more specifically relates to an exhaust pipe which includes a dual portion where an oxygen sensor is installed and which is connected to a dual exhaust manifold of an internal combustion engine.

2. Description of the Prior Art

An exhaust pipe connected to a dual exhaust manifold of an internal combustion engine includes a dual portion having two paths therein at an upstream portion thereof. When installing an oxygen sensor on the exhaust system including the dual exhaust manifold and the dual exhaust pipe, the oxygen sensor must be disposed at a communicating portion of the two paths or at a single path portion of the exhaust pipe which is connected to a downstream side end of the dual portion of the exhaust pipe, in order that the exhaust gas flowing from every cylinder of the engine can contact the oxygen sensor.

FIGS. 7–10 show one example of prior art arrangement of the oxygen sensor which is disclosed in Japanese Utility Model Publications Nos. SHO 61-19754 or SHO 60-3225. As shown in FIGS. 7–10, in the prior art the communicating portion 23 of the two paths are formed in the furthest upstream portion of the two paths, that is, in the dual exhaust manifold 21 for the purpose of preventing the temperature of the exhaust gas contacting the oxygen sensor from being excessively decreased, and the oxygen sensor 22 is installed at the communicating portion 23.

However, this prior art arrangement of the oxygen sensor 22 has the following drawbacks. Since the exhaust gas flowing from every cylinder has not yet been sufficiently mixed and tends to flow along the outside wall portions of the bent ports as shown by the flow lines 24 in FIG. 7 and such flow 24 can not contact the oxygen sensor 22, accurate detection of the oxygen contained in the exhaust gas flowing from every cylinder by the oxygen sensor 22 has been impossible. Further, since the exhaust gas flowing in the exhaust manifold 21 still retains too high temperatures, the oxygen sensor 22 easily suffers thermal damage as well as decreased durability.

Although contact of the oxygen sensor by the exhaust gas may be improved by providing an agitator for mixing the exhaust gas upstream of the communicating portion, such an agitator inevitably increases the back pressure of the engine as well as decreases the dual effect of the dual structure.

SUMMARY OF THE INVENTION

An object of the present invention is to provide an exhaust pipe for mounting an oxygen sensor, in which the exhaust gas flowing from every cylinder of an internal combustion engine is directed toward the oxygen sensor so as to contact the oxygen sensor without an accompanying increase in the back pressure of the engine, without resulting heavy thermal damage of the oxygen sensor, and without losing the dual effect of the dual manifold structure.

The above object can be achieved, according to the present invention, by an exhaust pipe for mounting an oxygen sensor, to be connected to a dual exhaust manifold of an internal combustion engine, the exhaust pipe including a dual portion which has two side-by-side paths therein and an axis extending between the two paths, the exhaust pipe comprising:

a communicating portion, formed partly in an axial direction of the dual portion, where the two paths communicate with each other, the communicating portion defining an oxygen sensor mounting position where the oxygen sensor to be installed is disposed; and tapered inwardly facing surfaces, located upstream of the oxygen sensor mounting position along the two paths and formed at portions of walls of the two paths which are located farther in a transverse direction from the axis of the dual portion than axes of the two paths, tapers of the tapered inwardly facing surfaces being determined such that extensions of the tapered inwardly facing surfaces are tangent to an outside surface of the oxygen sensor when the oxygen sensor is mounted in the dual portion.

In the exhaust pipe thus constructed, the exhaust gas which has flowed from the exhaust manifold into the dual portion of the exhaust pipe is entirely directed by the tapered inwardly facing surfaces toward the oxygen sensor. As a result, almost all of the exhaust gas flowing from every cylinder of the engine can contact the oxygen sensor despite the insufficient mixture of the exhaust gas, and accurate detection of the exhaust gas by the oxygen sensor becomes possible. This reliable detection is performed without providing any agitator in the exhaust paths. Also, by installing the oxygen sensor at the dual portion of the exhaust pipe downstream from the exhaust manifold, the temperature of the exhaust gas contacting the oxygen sensor is appropriately decreased, thereby preventing the oxygen sensor from suffering thermal damage.

BRIEF DESCRIPTION OF THE DRAWINGS

These and other objects and advantages of the present invention will become apparent from the following detailed description of the presently preferred exemplary embodiments of the invention taken in conjunction with the accompanying drawings, wherein.

DETAILED DESCRIPTION OF THE PREFERRED EMBODIMENTS

Figure 1:
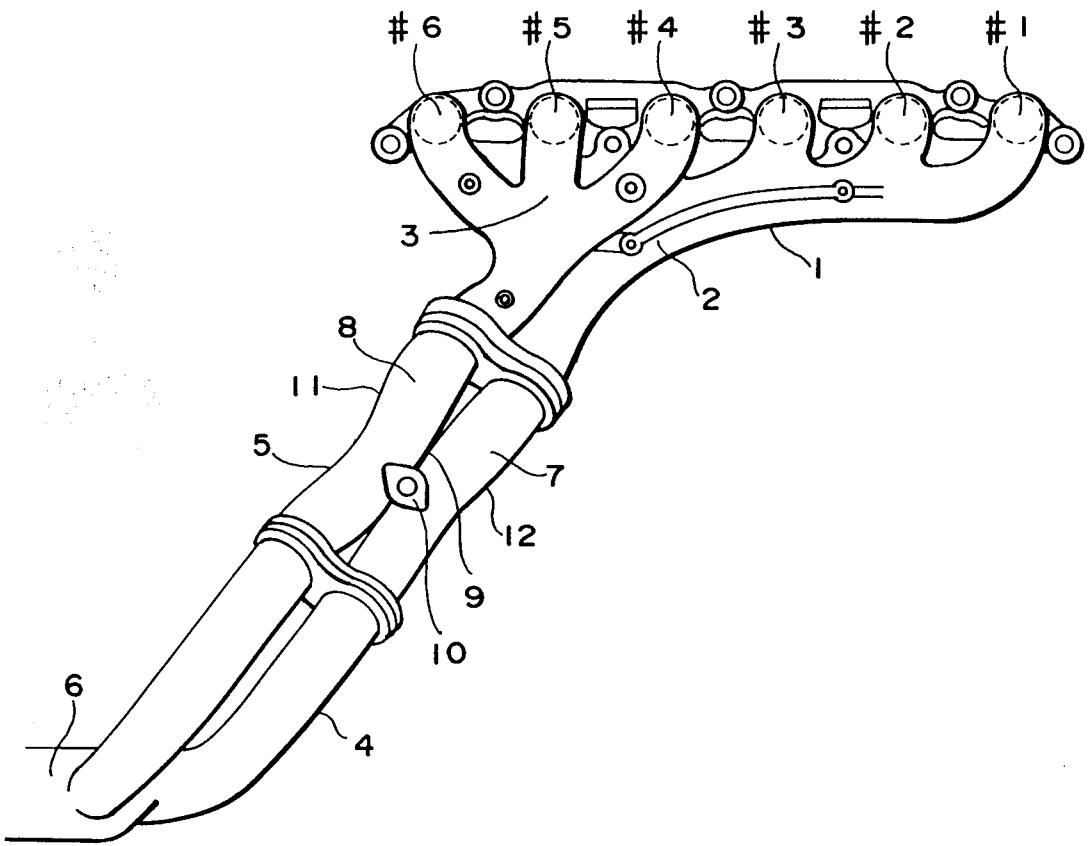
FIG. 1 is an oblique view of an exhaust pipe for installing an oxygen sensor, which is connected to a dual exhaust manifold, in accordance with the present invention.

FIG. 1 illustrates an exhaust pipe 4 of a dual-type which is connected to a dual exhaust manifold 1 of an internal combustion engine. The structure of FIG. 1 is common to all embodiments of the present invention. Although FIG. 1 shows an example applied to a six-cylinder internal combustion engine, the present invention is also applicable to a four-cylinder or an eight-cylinder engine.

In the dual exhaust manifold 1, three exhaust ports connecting to #1, #2 and #3 cylinders of the engine are connected to a first path 2 and the remaining three exhaust ports connecting to #4, #5 and #6 cylinders of the engine are connected to a second path 3. The #1 to #6 cylinders of the six-cylinder engine are disposed in the order of #1 to #6 from one end of the engine to the other end of the engine. The two paths 2 and 3 are separated from each other in the exhaust manifold 1.

As shown in FIG. 1, an exhaust pipe 4 of a dual type is connected to the dual exhaust manifold 1. The exhaust pipe 4 includes a dual portion 5, at an upstream portion of the exhaust pipe 4, where the exhaust pipe 4 is connected to the dual exhaust manifold 1. An oxygen sensor 10 to be installed on the exhaust pipe 4 is installed on the dual portion 5 of the exhaust pipe 4. The dual portion 5 has two paths 7 and 8 therein which are connected to the two paths 2 and 3 formed in the dual exhaust manifold 1, respectively. The dual portion 5 further has an axis positioned between the two paths 7 and 8 as shown FIGS. 2 to 4. As shown in FIG. 1, a remaining portion of the exhaust pipe 4 other than the dual portion 5 includes a single path portion 6 at a downstream portion of the exhaust pipe 4, and the two paths 7 and 8 formed in the dual portion 5 are connected to a single path formed in the single path portion 6.

The dual portion 5 of the exhaust pipe 4 has flanges, at both axial ends thereof, for detachably connecting the dual portion 5 by means of bolts (not shown) to the dual exhaust manifold 1 and to the remaining portion of the exhaust pipe.

The dual portion 5 of the exhaust pipe 4 comprises a communicating portion 9, formed partly in an axial direction of the dual portion 5, where the two paths 7 and 8 formed in the dual portion 5 contact each other so as to communicate with each other. The cros sections of the paths 7 and 8 formed in the dual portion 5 comprise two circles spaced from each other except for the communicating portion 9. The cross sections of the paths 7 and 8 formed in the dual portion 5 comprise a single batterfly shape at the communicating portion 9. The communicating portion 9 defines an oxygen sensor mounting location where the oxygen sensor 10 to be installed is disposed such that an axis of the oxygen sensor 10 lies in the plane where the two paths 7 and 8 communicate with each other. The dual portion 5 of the exhaust pipe 4 further comprises tapered inwardly facing surfaces 11 and 12 which are located upstream of the oxygen sensor installing position along the two paths 7 and 8. The tapered inwardly facing surfaces 11 and 12 are formed at portions of walls of the two paths 7 and 8 which are located farther in a transverse direction from the axis of the dual portion 5 than axes of the two paths 7 and 8. Tapers of the tapered inwardly facing surfaces 11 and 12 are determined such that extensions of the tapered inwardly facing surfaces 11 and 12 tangentially contact an outside surface of the oxygen sensor 10 when the oxygen sensor 10 is installed in the dual portion 5. A cross section of the oxygen sensor 10 is circular. A detecting portion of the oxygen sensor 10 to be installed is inserted into the communicating portion 9 at a right angle with respect to a plane including axes of the two paths 7 and 8.

Preferably, one transversely half portion of the dual portion 5, positioned on one side of the axis of the dual portion 5, and the other transversely half portion of the dual portion 5, positioned on the other side of the axis of the dual portion 5, are symmetrical to each other. In this instance, the axis of the dual portion 5 defines an axis of symmetry.

Figure 2:
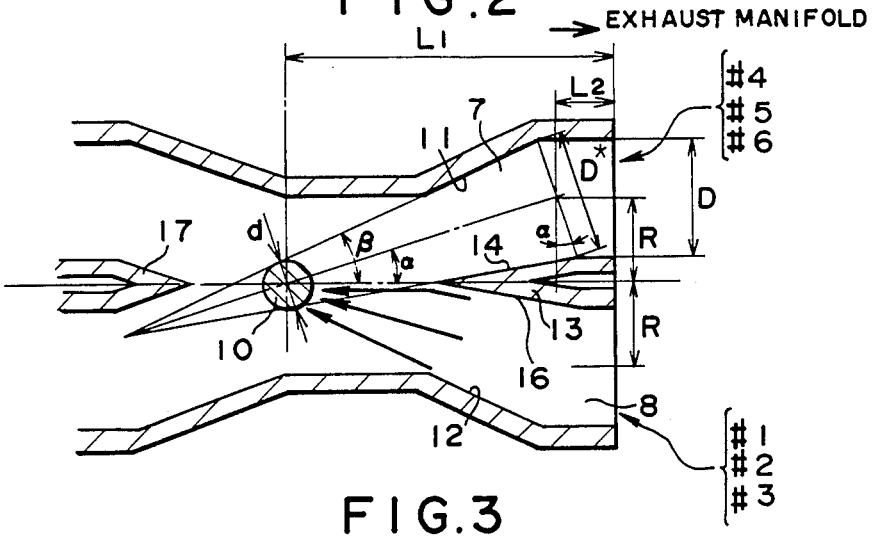
FIG. 2 is a sectional view of a dual portion of the exhaust pipe of FIG. 1 in accordance with the first embodiment of the present invention.
Figure 3:
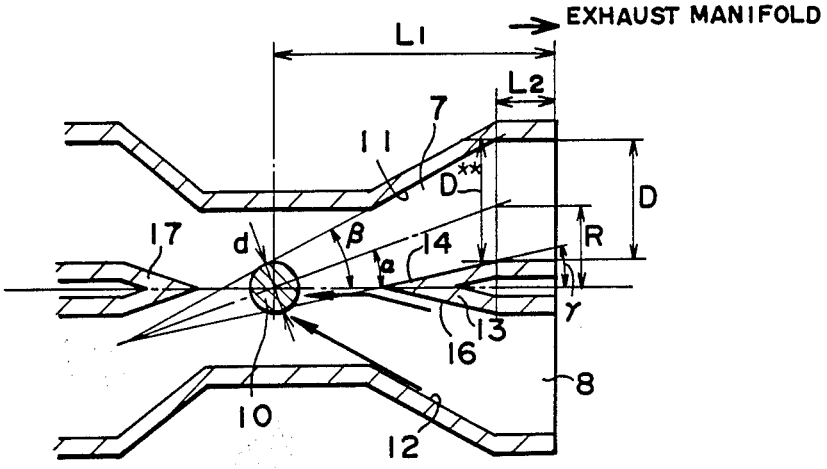
FIG. 3 is a sectional view of a dual portion of the exhaust pipe of FIG. 1 in accordance with the second embodiment of the present invention.
Figure 4:
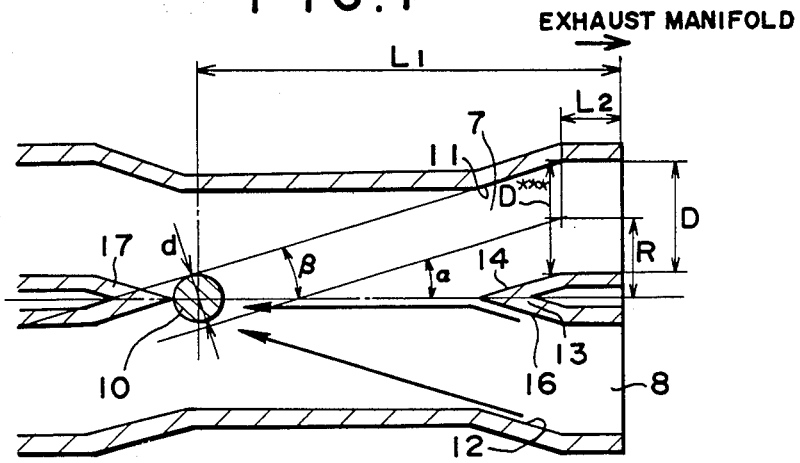
FIG. 4 is a sectional view of a dual portion of the exhaust pipe of FIG. 1 in accordance with the third embodiment of the present invention.

In more detail, as shown in FIGS. 2 to 4, the dual portion 5 comprises a first portion 5*a* to be detachably connected to the dual exhaust manifold 1, a second portion 5*b* integrally connected to the first portion 5*a*, a third portion 5*c* integrally connected to the second portion 5*b*, a fourth portion 5*d* integrally connected to the third portion 5*c*, and a fifth portion 5*e* integrally connected to the fourth portion 5*d*. The fifth portion 5*e* is detachably connected to the remaining portion of the exhaust pipe 4 other than the dual portion 5.

At the first portion 5*a*, the two paths 7 and 8 separate from each other and extend generally parallel to the axis of the dual portion 5. At the second portion 5*b*, the two paths 7 and 8 are still separated from each other but extend obliquely with respect to the axis of the dual portion 5 so as to approach said axis in a direction away from the first portion 5*a*. The tapered inwardly facing surfaces 11 and 12 are formed by the transversely outer portions of the walls of the two paths in the second portion 5*b*. At the third portion 5*c*, the two paths 7 and 8 extend parallel to the axis of the dual portion 5 and communicate with each other, thereby forming the communicating portion 9. At the fourth portion 5*d*, the two paths 7 and 8 again separate from each other and extend obliquely with respect to the axis of the dual portion 5 away from the axis in a direction away from the third portion 5*c*. At the fifth portion 5*e*, the two paths 7 and 8 are fully separated from each other and again extend generally parallel to the axis of the dual portion 5.

As shown in FIGS. 2–4, the second portion 5*b* of the dual portion 5 has an upstream side dividing wall 13 formed between the two paths 7 and 8 so as to separate the two paths 7 and 8 from each other at the second portion 5*b*. The fourth portion 5*d* has a downstream side dividing wall 17 formed between the two paths 7 and 8 at the fourth portion 5*d* so as to separate the two paths 7 and 8 from each other at the fourth portion 5*d*.

The above structures are common to all embodiments of the present invention. Those structures which differ from each other among the following three embodiments of the present invention will be explained below.

FIG. 2 illustrates the first embodiment of the present invention. In the dual portion 5 of the exhaust pipe 4 according to the first embodiment, the following dimensional relationships hold:

$$\alpha \geqq \tan^{-1}\{R/(L_1-L_2)\}$$

$$D^*=D/\cos\alpha$$

$$\beta \geqq \alpha + [\tan^{-1} \tfrac{1}{2} \cdot (D^* - d)/\{(L_1 - L_2)/\cos \alpha\}]$$

where:

D is a diameter of each of the two paths 7 and 8 at the first portion 5*a;*

R is a transverse distance between an axis of each of the two paths 7 and 8 at the first portion 5*a* and the axis of the dual portion 5;

d is a diameter of the cross section of the oxygen sensor 10 to be installed;

$L_1$ is a distance in the axial direction between an upstream end of the first portion 5*a* and the oxygen sensor mounting position;

$L_2$ is an axial distance between an upstream end of each axis of the two paths 7 and 8 at the second portion 5*b* and the upstream end of the first portion 5*a;*

$\alpha$ is an angle defined between each of the axes of the two paths 7 and 8 at the second portion 5*b* and the axis of the dual portion 5;

$\beta$ is an angle defined between each extension of the tapered inwardly facing surfaces 11 and 12 and the axis of the dual portion 5; and D* is a diameter of each of the two paths 7 and 8 at an upstream end of the second portion 5*b.*

Outwardly facing surfaces 14 and 16 of the upstream side dividing wall 13, which are positioned nearer to the axis of the dual portion 5 than are the axes of the two paths 7 and 8 at the second portion 5*b,* are tapered so as to approach each other in the direction away from the first portion 5*a,* thereby joining and terminating at one end of the second portion 5*b.* Tapers of the outwardly facing surfaces 14 and 16 are determined such that the outwardly facing surfaces 14 and 16 are symmetrical to the tapered inwardly facing surfaces 11 and 12 with respect to the axes of the two paths 7 and 8 at the second portion 5*b.* According to the symmetrical structure, extensions of the outwardly facing surfaces 14 and 16 tangentially contact the outside surface of the installed oxygen sensor 10 at portions of the oxygen sensor 10 located diametrically opposite to the portions where the extensions of the inwardly facing surfaces 11 and 12 tangentially contact the oxygen sensor 10.

The dimension R is determined so as to make the tapers of the outwardly facing surfaces 14 and 16 sufficiently small to prevent separation from the outwardly facing surfaces 14 and 16 of gas flowing through the second portion 5*b.*

FIG. 3 illustrates the dual portion 5 according to the second embodiment of the present invention. In the second embodiment, the following dimensional relationships hold:

$$\alpha \geqq \tan^{-1}\{R/(L_1 - L_2)\}$$

$$Du^{**} = D$$

$$\beta \geqq \tan^{-1}\{(R + D/2 - d/2)/(L_1 - L_2)\}$$

where:

D is a diameter of each of the two paths 7 and 8 at the first portion 5*a;*

R is a transverse distance between an axis of each of the two paths 7 and 8 at the first portion 5*a* and the axis of the dual portion 5;

d is a diameter of the cross section of the oxygen sensor 10 to be installed;

$L_1$ is an axial distance between an upstream end of the first portion 5*a* and the oxygen sensor installing position;

$L_2$ is an axial distance between an upstream end of each of axes of the two paths 7 and 8 at the second portion 5*b* and the upstream end of the first portion 5*a;*

$\alpha$ is an angle defined between each of the axes of the two paths 7 and 8 at the second portion 5*b* and the axis of the dual portion 5;

$\beta$ is an angle defined between each of the extensions of the tapered inwardly facing surfaces 11 and 12 and the axis of the dual portion 5; and D is a diameter of each of the two paths 7 and 8 at a downsteam end of the first portion 5***a.*

Outwardly facing surfaces 14 and 16 of the upstream side dividing wall 13, which are positioned nearer to the axis of the dual portion 5 than the axes of the two paths 7 and 8 at the second portion 5*b,* are tapered so as to approach each other in the direction away from the first portion 5*a,* thereby joining and terminating at one end of the second portion 5*b.* In the second embodiment, tapers of the outwardly facing surfaces 14 and 16 are arbitrary.

FIG. 4 illustrates the dual portion 5 according to the third embodiment of the present invention. In the third embodiment, the following dimensional relationships hold:

$$\alpha = \beta = \tan^{-1}\{(R + D/2 - d/2)/(L_1 - L_2)\}$$

$$D = D^{***}$$

where:

D is a diameter of each of the two paths 7 and 8 at the first portion 5*a;*

R is a transverse distance between an axis of each of the two paths 7 and 8 at the first portion 5*a* and the axis of the dual portion 5;

d is a diameter of the cross section of the oxygen sensor 10 to be installed;

$L_1$ is an axial distance between an upstream end of the first portion 5*a* and the oxygen sensor installing position;

$L_2$ is an axial distance between an upstream end of each of axes of the two paths 7 and 8 at the second portion 5*b* and the upstream end of the first portion 5*a;*

$\alpha$ is an angle defined between each of the axes of the two paths 7 and 8 at the second portion 5*b* and the axis of the dual portion 5;

$\beta$ is an angle defined between each of the extensions of the tapered inwardly facing surfaces 11 and 12 and the axis of the dual portion 5; and D* is a diameter of each of the two paths 7 and 8 at a downsteam end of the first portion 5***a.*

Preferably, the dimension $\alpha$ is not less than 30°.

Outwardly facing surfaces 14 and 16 of the upstream side dividing wall 13, which are positioned nearer to the axis of the dual portion 5 than are the axes of the two paths 7 and 8 at the second portion 5*b,* are tapered so as to approach each other in the direction away from the first portion 5*a,* thereby joining and terminating at one end of the second portion 5*b.* Tapers of the outwardly facing surfaces 14 and 16 are determined such that the outwardly facing surfaces 14 and 16 are parallel to the inwardly facing surfaces 11 and 12 of the second portion 5*b,* thereby making diameters of said two paths 7 and 8 constant in the directions along the axes of the two paths 7 and 8 at the second portion 5*b*.

Next, characteristics of the dual exhaust pipe according to the present invention will be explained, referring to FIGS. 5 and 6.

Figure 5:
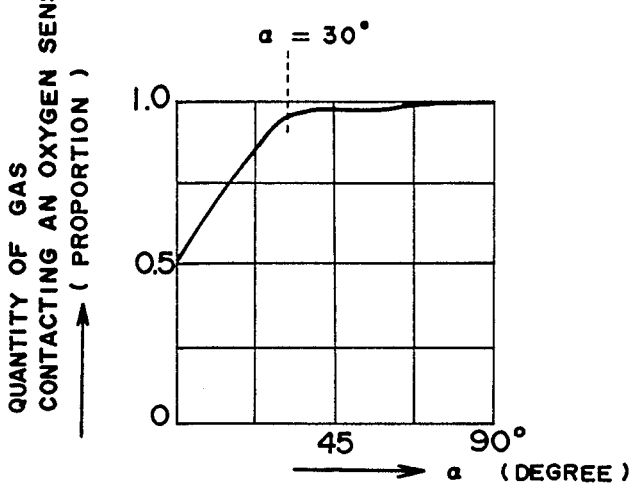
FIG. 5 is a graph showing the relationships between angle $\alpha$ and gas contacting characteristics in the third embodiment of the present invention.

FIG. 5 illustrates the results obtained in the tests which were performed using the exhaust pipe of the third embodiment. FIG. 5 illustrates relationships between the angle $\alpha$ and the quantity of the gas striking the oxygen sensor 10 when the angle $\alpha$ was varied. As will be easily understood from FIG. 5, almost all of the gas could contact the oxygen sensor when the angle $\alpha$ was selected to be not less than 30°. This is the reason why the angle $\alpha$ has been selected to be not less than 30° in the third embodiment. This good gas contact means that accurate detection of the exhaust gas oxygen content by the oxygen sensor 10 becomes possible.

Figure 6:
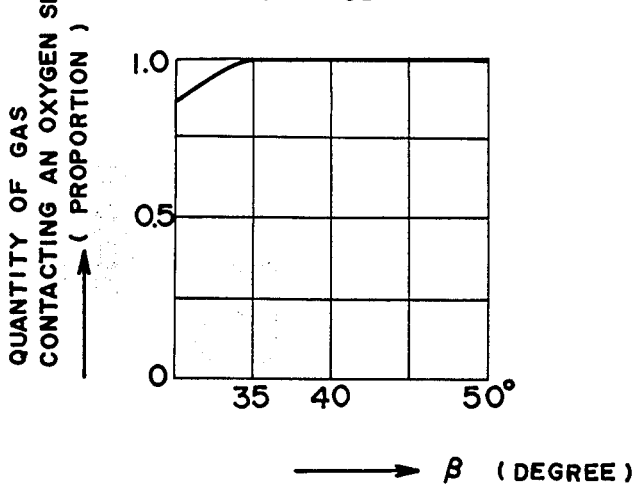
FIG. 6 is a graph showing the relationships between angle $\beta$ and gas contacting characteristics in the first and second embodiments of the present invention.
Figure 7:
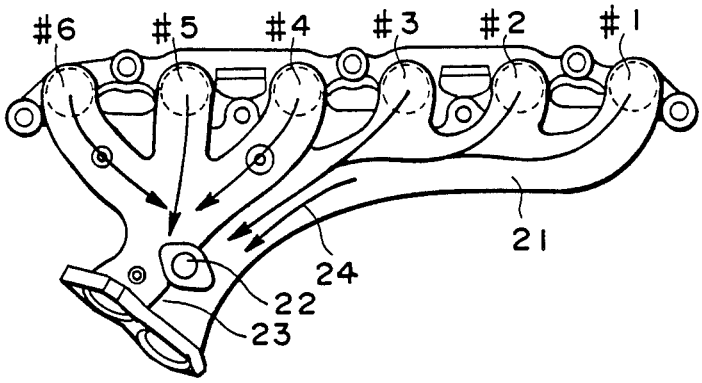
FIG.7 PRIOR ART
FIG. 7 is a plan view of a prior art dual exhaust manifold to be installed with an oxygen sensor.
Figure 8:
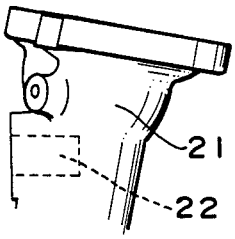
FIG.8 PRIOR ART
FIG. 8 is a side view of an oxygen sensor installing portion of the dual exhaust manifold of FIG. 7.
Figure 9:
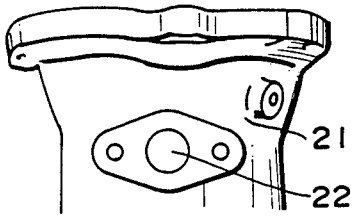
FIG.9 PRIOR ART
FIG. 9 is an elevational view of the oxygen sensor installing portion of FIG. 8; an FIG. 10 is a sectional view of the oxygen sensor installing portion of FIG. 9 where an oxygen sensor is installed.
Figure 10:
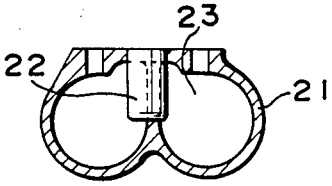
FIG.10 PRIOR ART

FIG. 6 illustrates the results obtained in tests using the exhaust pipe of the first and second embodiments. FIG. 6 shows the relation between the angle $\beta$ of the tapered inwardly facing surfaces 11 and 12 and the proportion of the gas contacting the oxygen sensor 10 when the angle $\beta$ was varied. In the tests, the angle $\alpha$ was fixed at 30°. The results obtained in the tests where the angle $\beta$ was selected to be 30° are also applicable to the third embodiment. As will be easily understood from FIG. 6, almost all of the gas flowing from every cylinder could contact the oxygen sensor when the angle $\beta$ was selected to be not less than 30° and very good gas contact was seen when the angle $\beta$ was selected to be not less than 35°. This means that the tapers of the tapered inwardly facing surfaces 11 and 12 have a great effect on the gas contact and that the gas flowing along the transversely outside portions of the wall of the first portion 5*a* can contact the oxygen sensor 10.

According to the present invention, the following effects can be obtained.

First, since the tapered inwardly facing surfaces 11 and 12 are provided upstream of the oxygen sensor 10, the flow of the exhaust gas is necessarily directed toward the oxygen sensor 10, and gas contact with the oxygen sensor 10 is improved to a great extent, as will be easily understood from FIGS. 5 and 6.

Second, since the oxygen sensor 10 is disposed further downstream than the dual type exhaust manifold, where an oxygen sensor has been installed in the prior art, the temperature of the exhaust gas contacting the oxygen sensor is decreased by about 80° C., and thermal damage to the oxygen sensor 10 will be decreased.

Third, since the communicating portion 9 is provided in the dual exhaust pipe, there is no necessity to provide a communicating portion in the dual type exhaust manifold, unlike the prior art, and since the exhaust gas flows generally parallel to the axis of the dual portion at the third portion 5*c*, the back pressure of the engine is not increased, and the power of the engine is maintained.

Finally, since the speeds of the gas flowing in the dual portion 5 are increased, due to throttling by the tapered inwardly facing surfaces 11 and 12 in the first an second embodiments, the heat dissipating ability of the exhaust pipe will be increased, and the prevention of thermal damage of the oxygen sensor 10 is even more likely, although this effect is not expected to occur in the third embodiment because the diameters of the two paths 7 and 8 are maintained substantially constant.

Although only a few preferred embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the scope of the present invention as defined by the following claims.

What is claimed is:

1. An exhaust pipe segment for mounting an oxygen sensor said segment comprising:

an upstream end adapted to be connected to a dual exhaust manifold of an internal combustion engine and being formed with two separated tubular paths, each path having a longitudinal axis and said segment having an axis positioned between the two paths;

a downstream end;

a communicating portion, axially spaced from said upstream end, wherein said two paths are open to each other so as to communicate with each other, said communicating portion including an oxygen sensor mounting position; and tapered wall surfaces of said two paths located upstream of said oxygen sensor mounting position which face said axis of the exhaust pipe segment and are located farther from said axis than the longitudinal axes of said two paths, the tapers of said tapered wall surfaces being determined such that longitudinal extensions of said tapered wall surfaces tangentially contact an outside surface of an oxygen sensor when said oxygen sensor is installed at said mounting position.

2. An exhaust pipe segment according to claim 1, wherein said oxygen sensor mounting position is adapted to receive a detecting portion of an oxygen sensor inserted into said communicating portion at a right angle with respect to a plane including the longitudinal axes of said two paths.

3. An exhaust pipe segment according to claim 1, wherein said upstream and downstream ends have flanges for detachably connecting said exhaust pipe segment to said dual exhaust manifold and to an exhaust pipe, respectively.

4. An exhaust pipe segment according to claim 1, wherein a portion containing one of said tubular paths on one side of the segment axis is symmetrical with a portion containing the other of said tubular paths on the other side of said segment axis, such that said axis of said exhaust pipe segment defines a axis of symmetry of said segment.

5. An exhaust pipe segment for mounting an oxygen sensor, said segment having an axis and comprising a first portion having an upstream end adapted to be connected to a dual exhaust manifold, a second portion axially contiguous to said first portion, a third portion axially contiguous to said second portion, a fourth portion axially contiguous to said third portion, and a fifth portion axially contiguous to said fourth portion, said first portion being formed with two tubular paths separated from each other and extending parallel to said axis of said exhaust pipe segment, each of said two paths having a longitudinal axis, at said second portion said two paths being separated from each other and extending obliquely with respect to said axis of said segment so as to approach said axis of said segment in a direction away from said first portion, said two obliquely extending paths having tapered wall surfaces facing said axis, at said third portion said two paths extending parallel to said axis of said exhaust pipe segment and being open to each other so as to communicate with each other, said third portion including an oxygen sensor mounting position located such that longitudinal extensions of said tapered wall surfaces tangentially contact an outside surface of an oxygen sensor when said sensor is installed at said mounting position, at said fourth portion said two paths being separated from each other and extending obliquely with respect to said axis of said exhaust pipe segment away from said axis in a direction away from said third portion, and at said fifth portion said two paths being separated from each other and extending parallel to said axis of said exhaust pipe segment.

6. An exhaust pipe segment according to claim 5, wherein said second portion has an upstream side dividing wall formed between said two paths so as to separate said two paths from each other at said second portion.

7. An exhaust pipe segment according to claim 6, wherein said fourth portion has a downstream side dividing wall formed between said two paths at said fourth portion so as to separate said two paths from each other at said fourth portion.

8. An exhaust pipe segment according to claim 6, wherein the following dimensional relationships hold:

$$\alpha \geqq \tan^{-1}\{R/(L_1-L_2)\}$$

$$D^*D/\cos\alpha$$

$$\beta \geqq \alpha+\tan^{-1}[\tfrac{1}{2}\cdot(D^*-d)/\{(L_1-L_2)/\cos\alpha\}]$$

where:

D is an inside diameter of each of said two paths in said first portion;

R is a transverse distance between the longitudinal axis of each of said two paths at said first portion and said axis of said exhaust pipe segment;

d is a diameter of a cross section of an oxygen sensor to be installed at said mounting position;

$L_1$ is an axial distance between said upstream end of said first portion and the oxygen sensor mounting position in the third portion;

$L_2$ is an axial distance between said upstream end of said first portion and the intersection of the longitudinal axes of the oblique paths in said second portion with the respective longitudinal axes of the parallel paths in said first portion;

$\alpha$ is an angle defined between each of said longitudinal axes of said two paths in said second portion and said axis of said exhaust pipe segment;

$\beta$ is an angle defined between each of said longitudinal extensions of said tapered wall surfaces and said axis of said exhaust pipe segment; and D* is a diameter of each of said two paths at an upstream end of said second portion.

9. An exhaust pipe segment according to claim 8, wherein wall surfaces of said upstream side dividing wall which are located nearer to said axis of said exhaust pipe segment than said longitudinal axes of said two paths in said second portion are tapered so as to approach each other in the direction away from said first portion, joining and terminating at a downstream end of said second portion, tapers of said wall surfaces nearer the segment axis being determined such that said nearer wall surfaces are symmetrical to said tapered wall surfaces facing the segment axis, with respect to the longitudinal axes of said two paths in said second portion

10. An exhaust pipe segment according to claim 9, wherein longitudinal extensions of said nearer wall surfaces tangentially contact outside surfaces of an oxygen sensor, when said oxygen sensor is installed at said sensor mounting position, at locations diametrically opposite to the locations where the respective longitudinal extensions of said surfaces facing the segment axis tangentially contact said oxygen sensor.

11. An exhaust pipe segment according to claim 8, wherein said dimension R is determined so as to reduce said tapers of said nearer wall surfaces to such an extent that a gas flow does not separate from said nearer wall surfaces when a gas flows through said second portion.

12. An exhaust pipe segment according to claim 6, wherein the following dimensional relationships hold:

$$\alpha \geqq \tan^{-1}\{R/(L_1-L_2)\}$$

$$D^{**}=D$$

$$\beta \geqq \tan^{-1}\}(R+D/2-d/2)/(L_1-L_2)\}$$

where:

D is a diameter of each of said two paths in said first portion;

R is a transverse distance between the longitudinal axis of each of said two paths at said first portion and said axis of said exhaust pipe segment;

d is a diameter of a cross section of an oxygen sensor to be installed at said mounting position;

$L_1$ is an axial distance between said upstream end of said first portion and the oxygen sensor mounting position in the third portion;

$L_2$ is an axial distance between said upstream end of said first portion and the intersection of the longitudinal axes of the oblique paths in said second portion with the respective longitudinal axes of the parallel paths in said first portion;

$\alpha$ is an angle defined between each of said longitudinal axes of said two paths in said second portion and said axis of said exhaust pipe segment;

$\beta$ is an angle defined between each of said longitudinal extensions of said tapered wall surfaces facing said segment axis and said axis of said segment; and D** is a diameter of each of said two paths at a downsteam end of said first portion.

13. An exhaust pipe segment according to claim 6, wherein the following dimensional relationships hold:

$$\alpha=\beta=\tan^{-1}\{(R+D/2-d/2)/(L_1-L_2)\}$$

$$D=D^{***}$$

where:

D is a diameter of each of said two paths in said first portion;

R is a transverse distance between the longitudinal axis of each of said two paths at said first portion and said axis of said exhaust pipe segment;

d is a diameter of a cross section of said oxygen sensor to be installed at said mounting position;

$L_1$ is an axial distance between said upstream end of said first portion and the oxygen sensor mounting position in the third portion;

$L_2$ is an axial distance between said upstream end of said first portion and the intersection of the longitudinal axes of the oblique paths in said second portion with the respective longitudinal axes of the parallel paths in said first portion;

$\alpha$ is an angle defined between each of said longitudinal axes of said two paths in said second portion and said axis of said exhaust pipe segment;

$\beta$ is an angle defined between each of said longitudinal extensions of said tapered wall surfaces facing said segment axis and said axis of said segment; and D*** is a diameter of each of said two paths at a downsteam end of said first portion.

14. An exhaust pipe segment according to claim 13, wherein said angle $\beta$ is not less than 30°.

15. An exhaust pipe segment according to claim 13, wherein the surfaces of said upstream side dividing wall which are positioned nearer to said axis of said exhaust pipe segment than said longitudinal axes of said two paths at said second portion are tapered so as to approach each other in the direction away from said first portion, joining and terminating at a downstream end of said second portion, tapers of said wall surfaces nearer the segment axis being determined such that said nearer wall surfaces are parallel to said wall surfaces facing the segment axis in said second portion, thereby making diameters of said two paths constant in the directions along said longitudinal axes of said two paths in said second portion.

* * * * *

UNITED STATES PATENT AND TRADEMARK OFFICE

CERTIFICATE OF CORRECTION

PATENT NO. : 4,745,742

DATED : 24 May 1988

INVENTOR(S) : Mitsuhiro NADA et al.

It is certified that error appears in the above-identified patent and that said Letters Patent is hereby corrected as shown below:

| Column | Line | Correction |
|---|---|---|
| 3 | 02 | change "an" to --and--. |
| 3 | 37 | change "shown FIGS." to --shown in FIGS.--. |
| 3 | 52 | change "cros" to --cross--. |
| 3 | 57 | change "batterfly" to --butterfly--. |
| 5 | 57 | change "Du**=D" to --D**=D--. |
| 7 | 59 | change "an" to --and--. |
| 8 | 10 | Insert a comma after "sensor". |
| 9 | 32 | change "D*D/cos α" to --D*=D/cos α--. |
| 10 | 25 | change "}" to --{-- |

Signed and Sealed this

Twenty-seventh Day of September, 1988

*Attest:*

*Attesting Officer*

DONALD J. QUIGG

*Commissioner of Patents and Trademarks*